US008387941B2

(12) United States Patent
Qin et al.

(10) Patent No.: US 8,387,941 B2
(45) Date of Patent: Mar. 5, 2013

(54) UPPER-BEARING MOVABLE FORMWORK FOR CONSTRUCTING CONTINUOUS BOX GIRDER FOR BRIDGE SUPERSTRUCTURE

(75) Inventors: Shunquan Qin, Hubei (CN); Tao Ma, Hubei (CN); Sen Yao, Hubei (CN); Bin Zhu, Hubei (CN); Rongchun Guo, Hubei (CN)

(73) Assignee: China Major Bridge Engineering Co., Ltd., Wuhan, Hubel (CN)

( * ) Notice: Subject to any disclaimer, the term of this patent is extended or adjusted under 35 U.S.C. 154(b) by 175 days.

(21) Appl. No.: 13/057,347

(22) PCT Filed: Jul. 30, 2009

(86) PCT No.: PCT/CN2009/072990

§ 371 (c)(1),
(2), (4) Date: Feb. 3, 2011

(87) PCT Pub. No.: WO2010/015178

PCT Pub. Date: Feb. 11, 2010

(65) Prior Publication Data

US 2011/0133052 A1 Jun. 9, 2011

(30) Foreign Application Priority Data

Aug. 6, 2008 (CN) ..... 2008 1 0134898

(51) Int. Cl.
*E04G 13/00* (2006.01)
*E01D 21/00* (2006.01)

(52) U.S. Cl. ..... 249/1; 14/77.1

(58) Field of Classification Search ..... 249/1, 18, 249/19, 23, 24; 14/77.1; 264/31, 33; 425/63, 425/64

See application file for complete search history.

(56) References Cited

U.S. PATENT DOCUMENTS 4,103,861 A * 8/1978 Buchler et al. ..... 249/20
4,630,798 A * 12/1986 Muller ..... 249/50
4,692,955 A * 9/1987 Kinkel ..... 14/74.5
5,271,596 A * 12/1993 Holcomb et al. ..... 249/24

FOREIGN PATENT DOCUMENTS

CN 201065511 5/2008
DE 3935076 A1 * 4/1991
JP 02197671 A * 8/1990

OTHER PUBLICATIONS

Jia,Weizhong;Zhang,Aihua.Design and Construction of MSS650 Movable Shuttering Form with SelfTraveling Supporting Brackets. World Bridges.Jun. 20, 2008,S1 ,pp. 35-37issn1671-7767.

* cited by examiner

*Primary Examiner* — Michael Safavi

(57) ABSTRACT

An upper-bearing typed movable formwork used for cast-in-situ of concrete box girder in bridge engineering, comprising left and right legs (7) which are respectively fixed on a pier, left and right longitudinal/transverse sliding mechanisms (9), bearing devices and a template system. The left and right longitudinal/transverse sliding mechanisms (9) are respectively arranged on the left and right legs (7) and can move horizontally along the left and right legs (7), the bearing devices are respectively fixed on the left and right longitudinal/transverse sliding mechanisms (9), the template system comprises a bottom formwork (6), an internal formwork (3), a left formwork and a right formwork, the bottom formwork (6) is formed by screw connection of a left bottom formwork and a right bottom formwork (6*a*,6*b*) which are symmetrical about the axis line of the concrete box girder, two ends of the bottom formwork are respectively fixed on two opposite internal side surfaces of the left main beam and the right main beam (1). The movable formwork also comprises a plurality of adjustable supporting rods (14) used for supporting the template system.

8 Claims, 7 Drawing Sheets

UPPER-BEARING MOVABLE FORMWORK FOR CONSTRUCTING CONTINUOUS BOX GIRDER FOR BRIDGE SUPERSTRUCTURE

TECHNICAL FIELD

The present invention relates to technologies of constructing a superstructure box girder in bridge engineering, and more particularly to an upper-bearing typed movable formwork used for cast-in-situ of concrete box girder.

BACKGROUND OF THE INVENTION

An upper-bearing typed movable formwork is construction equipment for bridge superstructure construction, and especially applicable to production of a concrete simple box girder or continuous box girder. According to different relative positions of an upper-bearing typed movable formwork main girder and the concrete box girder, the upper-bearing typed movable formwork is classified into a deck type and a through type, in which the main girder of the through upper-bearing typed movable formwork is located above the concrete box girder, and the main girder of the upper-bearing typed movable formwork is located below the concrete box girder. Compared with the through upper-bearing typed movable formwork, the upper-bearing typed movable formwork has the advantages of an open working plane and no additional load generated on the concrete box girder when the scaffolding system runs through holes, and is widely applied in engineering practice. For the conventional upper-bearing typed movable formwork, the main girder is located below the concrete box girder; generally, one girder is disposed at two sides of a pier shaft respectively, a transverse truss (or a transverse steel box girder) is usually disposed at the top or one side of the main girder, a formwork system is disposed on the top of the transverse truss (or the transverse steel box girder), and the load (the dead weight of the concrete box girder, and the side pressure of the newly-cast concrete, and so on) of the upper-bearing typed movable formwork is transferred to the transverse truss (or the transverse steel box girder) through the formwork system, and then is transferred onto the main girder of the upper-bearing typed movable formwork.

The technical solution of the conventional upper-bearing typed movable formwork has the following disadvantages:

(a) Large dead weight: firstly, since the formwork system is disposed on the top of the transverse truss (the transverse steel box girder), the rigidity of the formwork system cannot be fully utilized, and the transverse truss (the transverse steel box girder) needs to bear the entire load, which requires the transverse truss to have a great rigidity and a large dead weight; additionally, the deformation value of the upper-bearing typed movable formwork is a sum of the deformation values of the formwork system, the transverse truss (the transverse steel box girder), and the main girder, and thus the structure deformation is great and relatively soft, and in the condition of the same rigidity, the upper-bearing typed movable formwork needs to consume more steel.

(b) High occupation space: below the bottom surface of the concrete box girder, the height of the occupation space of the conventional upper-bearing typed movable formwork is a sum of heights of structures such as the bottom formwork system, the transverse truss (the transverse steel box girder), the main girder, the vertical and horizontal transfer system, and a landing leg; when the height of the pier shaft is close to and even smaller than the sum of the heights, the upper-bearing typed movable formwork operation is difficult, and even cannot be implemented. Low pier shafts are usually used in passenger railway bridges in China.

(c) Unreasonable structure stress: the deployment of the structural system of the conventional upper-bearing typed movable formwork determines the disadvantages that the transverse truss (the transverse steel box girder) is bent, the load of web plates at the inner and outer sides of the girder is not even, and the additional torque is great, and the structure stress is unreasonable, thus resulting in increase of the dead weight of the structures and increase of risks.

(d) Many horizontal transfer mechanisms and complicated operations: for the conventional upper-bearing typed movable formwork, the transverse truss (the transverse steel box girder) and formwork system are divided into several individual action units longitudinally, each unit is equipped with a set of horizontal transfer mechanisms, and when the upper-bearing typed movable formwork runs, the horizontal transfer mechanisms are operated respectively, so that the action units are traversed one by one. The technical solution needs many horizontal transfer mechanisms and many procedures.

SUMMARY OF THE INVENTION

The technical problem to be addressed by the present invention is to solve the problem that the upper-bearing typed movable formwork has a large dead weight and a high occupation space, and the operation of the horizontal transfer mechanisms is complicated. The advantages of the invention are to utilize one energy and impetus in one direction as convenient power source so as to exert the latent energy of the generating equipment and improve the output efficiency.

To solve the above technical problem, the technical solution adopted by the present invention is to provide an upper-bearing typed movable formwork, comprising: left and right landing legs, respectively fixed on upper left and right sides of a pier shaft; left and right vertical and horizontal transfer mechanisms; a bearing device; and a formwork system.

The left and right vertical and horizontal transfer mechanisms are respectively disposed on the left and right landing legs and move horizontally along the left and right landing legs.

The bearing device includes left and right main girders, respectively fixed on the left and right vertical and horizontal transfer mechanisms; and two groups of left and right guide girders, respectively fixedly connected to front and, back ends of the left and right main girders.

The formwork system includes:

A bottom formwork, an inner formwork, and left and right formworks, in which the bottom formwork is formed by connecting the left and right bottom formworks disposed symmetrically with respect to an axis of the concrete box girder through a bolt, two ends of the bottom formwork are respectively fixed on two opposite inner sides of the left and right main girders; the inner formwork is centrally disposed on the bottom formwork; and the left and right formworks are respectively disposed on the bottom formwork, and located at left and right sides of the inner formwork, and gaps for forming the concrete box girder are disposed between left and right outer sides of the left and right formworks and the inner formwork.

In order to strengthen the rigidity of the bottom formwork, left and right bottom formwork struts are further included. An inner web plate is respectively disposed on two opposite sides of the left and right main girders, and left and right bottom formwork connecting hinge support and a bottom formwork strut connecting hinge support are respectively disposed on the inner web plate, two ends of the bottom formwork are respectively hinged with the left and right bottom formwork connecting hinge supports, and the left and right bottom formwork struts are respectively hinged with lower surfaces of the left and right bottom formworks and the bottom formwork connecting hinge supports on the inner web plate of the left and right main girders.

In the above solution, the left and right formworks include a left and right wing formwork and a left and right side formwork respectively. The left and right wing formworks and the left and right side formworks are fixedly connected to each other respectively, and lower ends of the left and right side formworks are fixedly supported on the bottom formwork; outer surfaces of the left and right wing formworks pass through left and right wing formwork upper struts and left and right wing formwork lower struts respectively, and the left and right wing formworks are hinged on upper surfaces of the left and right main girders respectively through left and right side formwork upper struts, left and right side formwork middle struts, and left and right side formwork lower struts.

At least three vertical oblong holes are opened on the inner web plate of the left and right main girders, at least three round holes A are opened on bottom plates of the left and right bottom formwork connecting hinge supports, and the left and right bottom formwork connecting hinge supports are connected with the inner web plate through a bolt. A contact surface of the left and right bottom formwork connecting hinge supports and the inner web plate of the left and right main girders is a rough surface machined with sandblasting for rusting or aluminum spraying.

An outer web plate is respectively disposed at outer sides of the left and right main girders, the inner web plate at two sides of bottom formwork stmt connecting hinge supports is disposed with at least two holes B running through the inner and outer web plates of the left and right main girders symmetrically; and finish rolled threaded steel bars A of a number equal to that of the holes B are fixedly connected with the outer web plate of the left and right main girders respectively through the holes B.

A portion of the finish rolled threaded steel bars A located between the inner and outer web plates of the left and right main girders is respectively sleeved with stiffened steel tubes, and two ends of the stiffened steel tubes are respectively fixed with the inner and outer web plates of the left and right main girders by welding.

Left and right brackets are embedded at two sides of the pier shaft, the left and right landing legs are respectively fixedly connected to the left and right brackets, and left and right landing legs at two sides of the same pier shaft are fixed diagonally with a finish rolled threaded steel bar B.

The left and right bottom formwork struts, the left and right wing formwork upper struts, the left and right wing formwork lower struts, the left and right side formwork upper struts, the left and right side formwork middle struts, and the left and right side formwork lower struts respectively include a supporting steel tube, a left nut, a right nut, left and right screws connected with the left and right nuts through threads, and at least two rotation handles, in which rotation directions of inner threads of the left and right nuts are opposite, the inner threads are respectively welded at two ends of the supporting steel tubes, and the at least two rotation handles are respectively disposed on outer surfaces of the supporting steel tube.

According to the present invention, the bottom formwork is used to replace the transverse truss (or the transverse steel box girder) and has a small dead weight, the main girder can reasonably enter the space above the concrete box girder, and the upper-bearing typed movable formwork occupies less height space below the concrete box girder, and can be adapted to lower pier shafts. With the bottom formwork, the left and right bottom formwork struts, and the finish rolled threaded steel bars A, a stable bearing system is formed, and the rigidity of the bottom formwork is utilized effectively. By reasonably arranging adjustable struts of the wing formworks and the side formworks, the stress of two web plates of the main girder is even, and thus the horizontal deformation of the girder is effectively reduced.

THE DRAWINGS

Figure 7A:
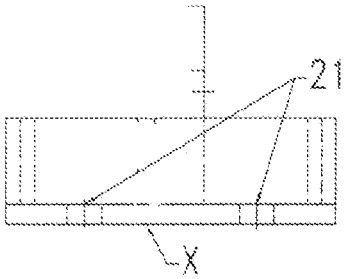
Figure 7B:
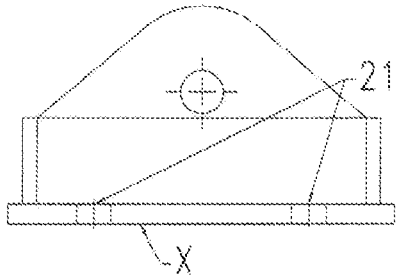
Figure 7C:
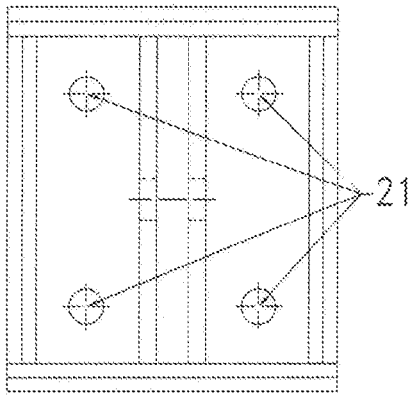

FIG. 7*a* is a schematic structural view of left and right bottom formwork connecting hinge supports according to the present invention;

FIG. 7*b* is a left view of FIG. 7A;

FIG. 7*c* is a top view of FIG. 7A; and

Figure 8:
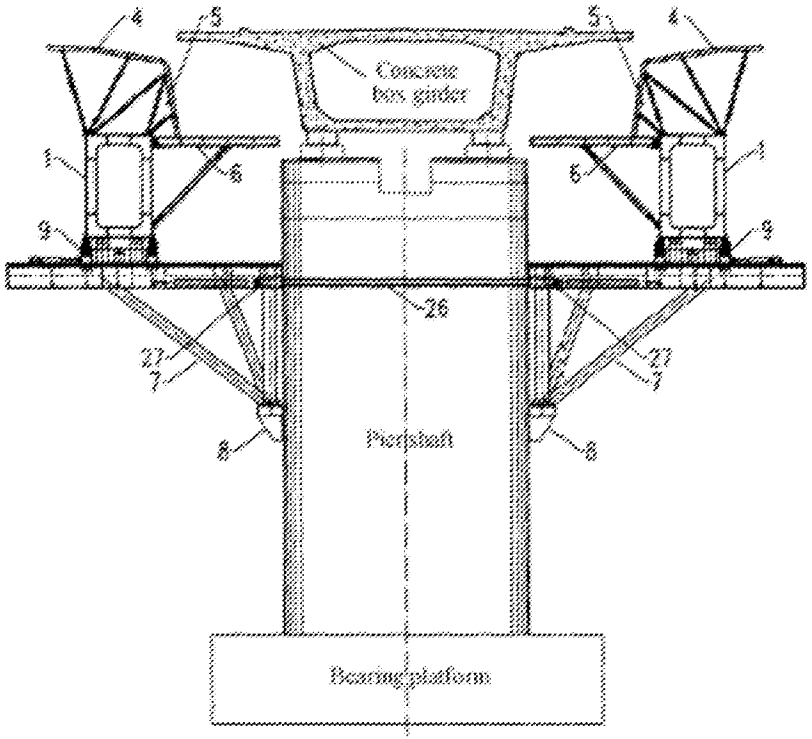

FIG. 8 is a schematic cross-sectional view along line A-A of the present invention in a running state.

The meanings of the serial numbers in the drawings are as follows:

1—left and right main girder, 2—left and right guide girder, 3—inner formwork, 4—left and right wing formwork, 5—left and right side formwork, 6—bottom formwork, 6*a*—left bottom formwork, 6*b*—right bottom formwork, 7—left and right landing leg, 8—pier shaft embedded bracket, 9—vertical and horizontal transfer mechanism, 10—left and right bottom formwork connecting hinge, 11—left and right bottom formwork connecting hinge support, 12—bottom formwork strut connecting hinge support, 13—hinge C, 14—left and right bottom formwork strut, 15—left and right wing formwork upper strut, 16—left and right wing formwork lower strut, 17—left and right side formwork upper strut, 18—left and right side formwork middle strut, 19—left and right side formwork lower strut, 20—oblong hole, 21—hole A, 22—hole B, 23—finish rolled threaded steel bars A, 24—anchorage gear A, 25—stiffened steel tube, 26—finish rolled threaded steel bars B, 27—anchorage gear B, 28—supporting steel tube, 29—left nut, 30—right nut, 31—rotation handle, 32—left screw, and 33—right screw.

DETAILED DESCRIPTION

The present invention is described below in detail with reference to the accompanying drawings.

Figure 1:
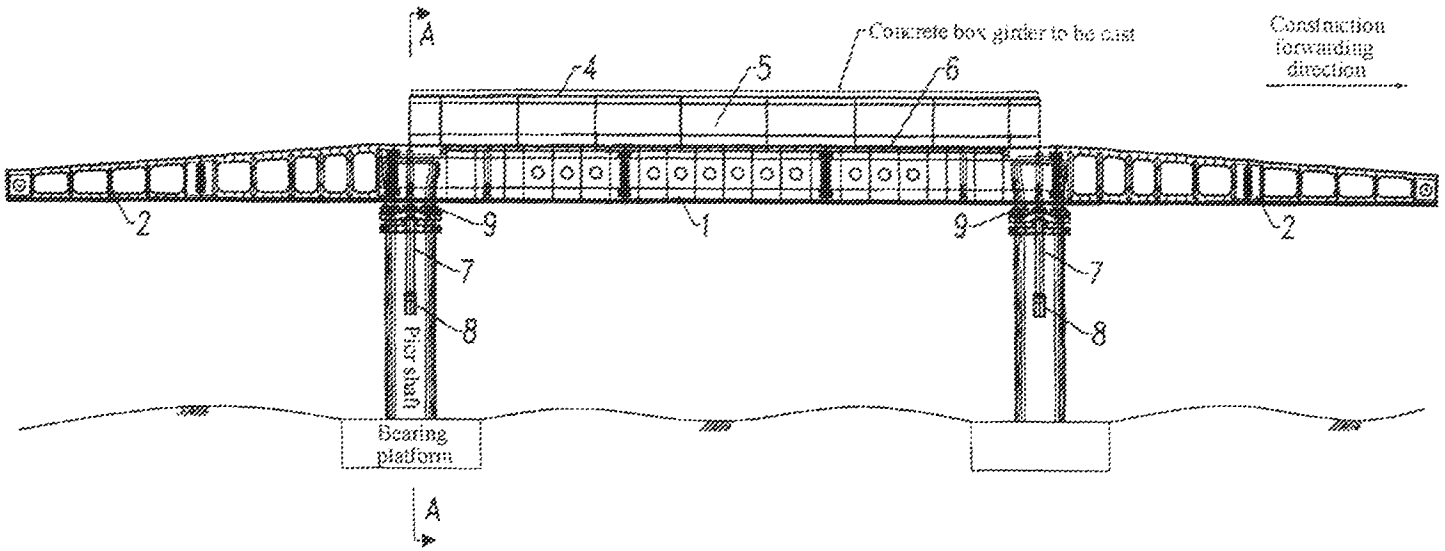
FIG. 1 is a front view of the present invention.
Figure 2:
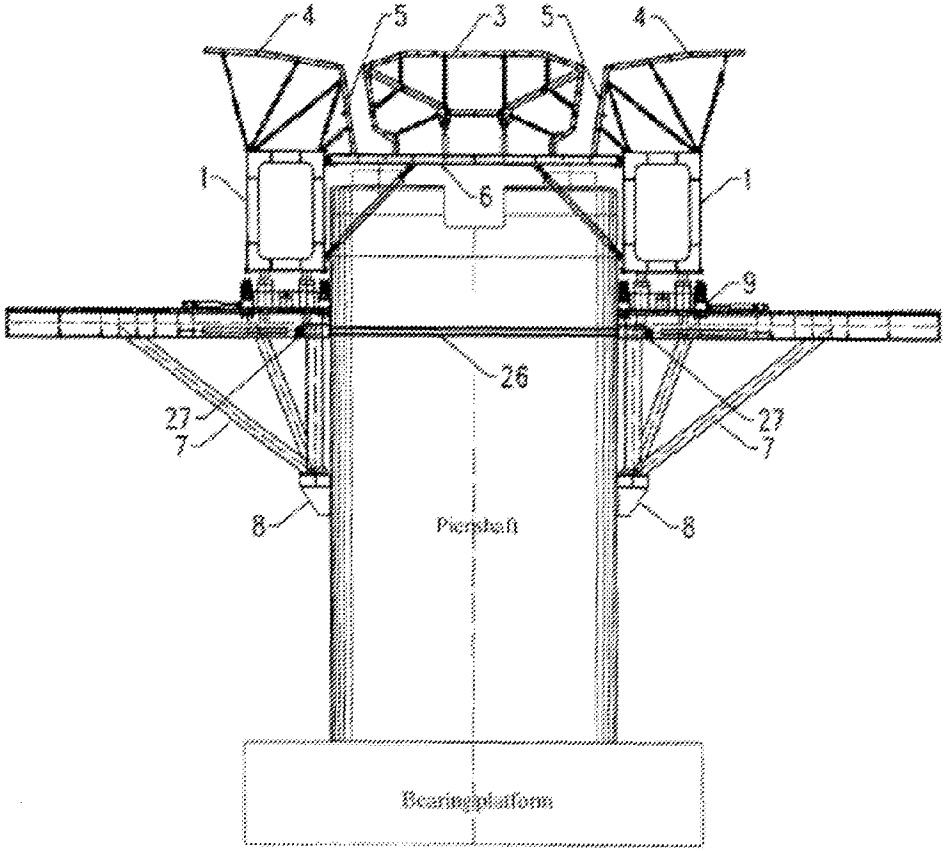
FIG. 2 is a schematic cross-sectional view along line A-A in a concrete casting state according to the present invention.

As shown in FIG. 1 and FIG. 2, the present invention includes left and right landing legs 7, left and right vertical and horizontal transfer mechanisms 9, a bearing device, and a formwork system. Left and right brackets 8 are embedded at two sides of a pier shaft. The embedded brackets 8 are installed during the construction of the pier shaft, the left and right landing legs 7 are fixedly connected to the left and right brackets 8, the landing legs 7 at two sides of the same pier shaft are fixed on the pier shaft by pulling diagonally with a finish rolled threaded steel bars B 26 and an anchorage gear B 27, and the left and right vertical and horizontal transfer mechanisms 9 are respectively disposed on the left and right landing legs 7 and move left and right along the left and right landing legs 7 horizontally.

The bearing device includes left and right main girders 1 respectively fixed on the left and right vertical and horizontal transfer mechanisms 9 and two groups of left and right guide girders 2 respectively fixedly connected to front and back ends of the left and right main girders 1.

The formwork system includes a bottom formwork 6, an inner formwork 3, and left and right formworks, which are disposed symmetrically with respect to a centerline of the pier shaft; in which the bottom formwork 6 is disposed between the left and right main girders 1 and is close to the top of the left and right main girders 1, the inner formwork 3 is centrally disposed on the bottom formwork 6; and the left and right formworks are respectively located at left and right sides of the inner formwork 3, and gaps for forming the concrete box girder are disposed between left and right sides of the left and right formworks and the inner formwork 3.

Figure 3:
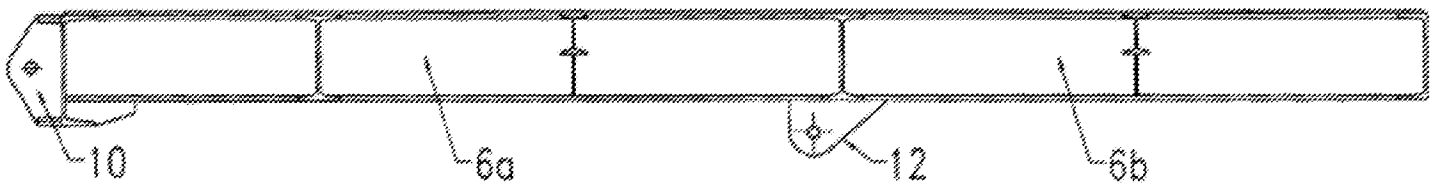
FIG. 3 is a schematic structural view of a bottom formwork according to the present invention.
Figure 4:
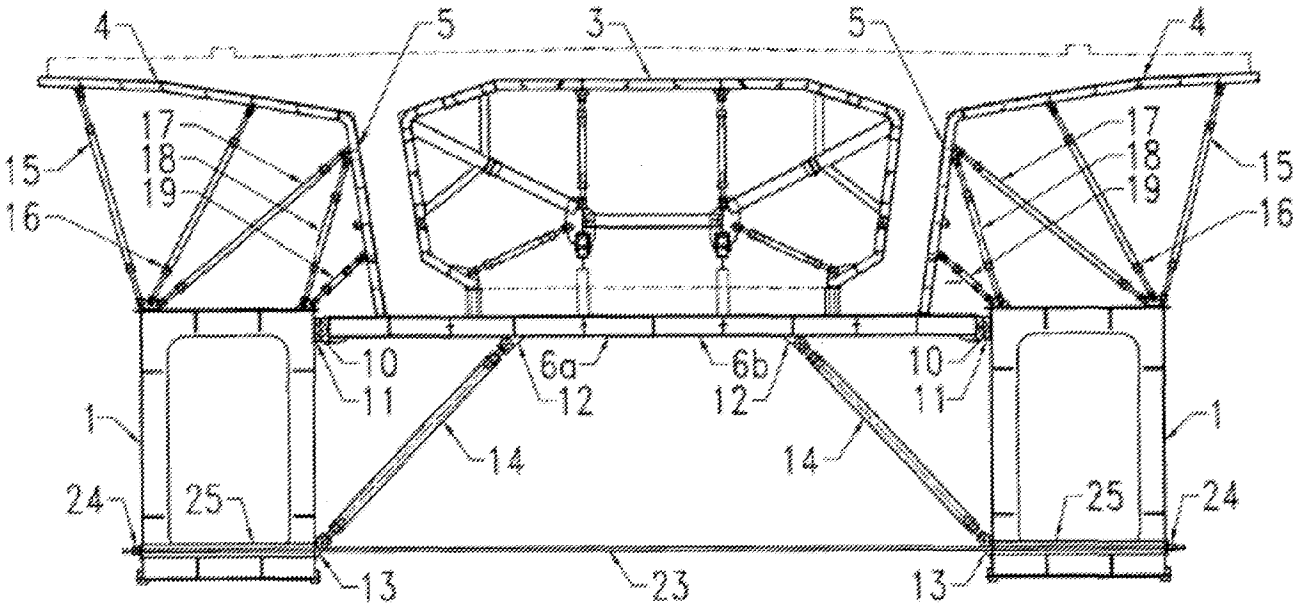
FIG. 4 is a schematic structural view of a formwork system according to the present invention.

As shown in FIG. 3 and FIG. 4, the bottom formwork 6 is formed by connecting left and right bottom formworks 6*a* and 6*b* through a bolt, the left and right bottom formworks 6*a* and 6*b* are respectively welded by profiled bars and steel plates and are disposed symmetrically with respect to an axis of the concrete box girder, left and right bottom formwork connecting hinges are respectively disposed at outer ends of the left and right bottom formworks 6*a* and 6*b*, and a bottom formwork strut connecting hinge support 12 is respectively disposed on bottom surfaces. An inner web plate is respectively disposed on two opposite sides of the left and right main girders 1, left and right bottom formwork connecting hinge supports 11 and bottom formwork strut connecting hinge supports 12 are respectively disposed on the inner web plate, the left and right bottom formwork connecting hinges 10 on the left and right bottom formworks 6*a* and 6*b* are respectively hinged with the left and right bottom formwork connecting hinge supports 11 on the inner web plate of the left and right main girders 1, two ends of left and right bottom formwork struts 14 are respectively hinged with the bottom formwork strut connecting hinge supports 12 on bottom surfaces of the left and right bottom formworks 6*a* and 6*b* and the bottom formwork connecting hinge supports 12 on the inner web plate of the left and right main girders 1.

The left and right formworks respectively include left and right wing formworks 4 and left and right side formworks 5. The left and right wing formworks 4 are supported at an outer side of the top surface of the left and right main girders 1 through left and right wing formwork upper struts 15 and left and right wing formwork lower struts 16, the left and right side formworks 5 are supported at the outer side of the top surface of the left and right main girders 1 through left and right side formwork upper struts 17, and is supported at an inner side of the top surface of the left and right main girders 1 through left and right side formwork middle struts 18 and left and right side formwork lower struts 19; and the left and right wing formworks 4 and the left and right side formworks 5 are respectively fixedly connected to each other, and lower ends of the left and right side formworks 5 are respectively fixedly supported on the bottom formwork 6.

Figure 5:
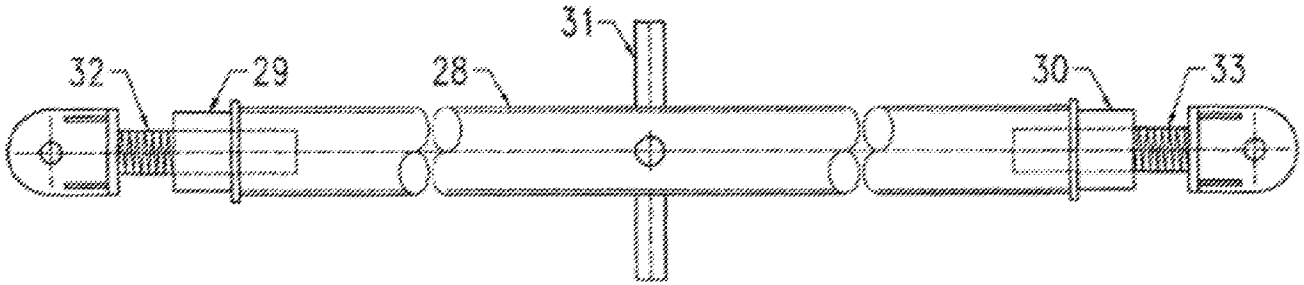
FIG. 5 is a schematic view of an adjustable strut according to the present invention.
Figure 6:
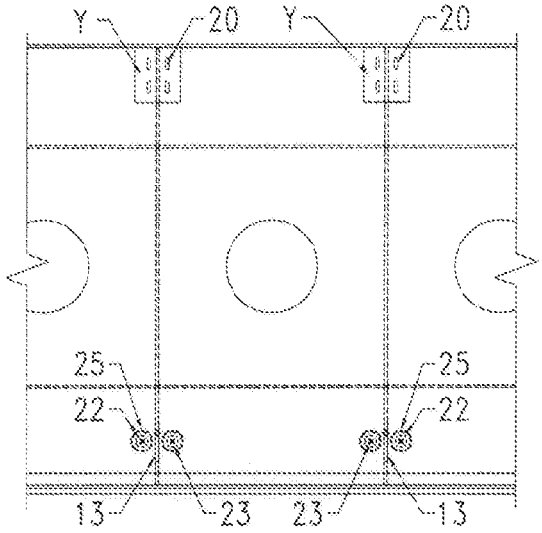
FIG. 6 is a schematic structural view of an inner web plate on left and right main girders according to the present invention.

The left and right bottom formwork struts 14, the left and right wing formwork upper struts 15, left and right wing formwork lower struts 16, left and right side formwork upper struts 17, left and right side formwork middle struts 18, and left and right side formwork lower struts 19 are called as adjustable struts collectively. As shown in FIG. 5, the common construction features of the adjustable struts are as follows: a supporting steel tube 28 is included, one end is lathed with a left nut 29 with positive inner threads through welding, the other end is lathed with a right nut 30 with reverse inner threads through welding, and the body is lathed with at least two rotation handles 31 through welding; a left screw 32 is lathed with right-hand threads matching the left nut 29 through welding, a right screw 33 is lathed with left-hand threads matching the right nut 30 through welding; and outer diameters of the left screw 32 and the right screw 33 are both smaller than an inner diameter of the supporting steel tube 28, and the left screw 32 and the right screw 33 are rotatably installed on the left nut 29 and the right nut 30 and extend into the supporting steel tube 28. Lengths, diameters, and adjustment amounts of the adjustable struts are different, and should be determined by calculation according to actual uses and stress requirements for a specific adjustable strut.

The bottom formwork 6 can be tuned up and down in a vertical direction. As shown in FIG. 6 and FIGS. 7*a* to 7*c*, at least three oblong holes 20 are disposed at installation positions corresponding to the left and right bottom formwork connecting hinge supports 11 on the inner web plate of the left and right main girders 1, and at least three holes A 21 are disposed at positions corresponding to the oblong holes 20 on a bottom plate of the left and right bottom formwork connecting hinge supports 11, so as to be connected to the left and right main girders 1 with a bearing type high-strength bolt; the friction coefficient of contact areas X and Y of the left and right bottom formwork connecting hinge supports 11 and the inner web plate of the left and right main girders 1 is increased by sandblasting for rusting or aluminum spraying, and the design of the oblong holes can realize the up and down tuning of the bottom formwork. At least two round holes B 22 running through the inner and outer web plates of the left and right main girders 1 are disposed symmetrically at two sides of the bottom formwork strut connecting hinge supports 13; the finish rolled threaded steel bars A 23 passes through the round holes B 22, and two ends are respectively connected to an anchorage gear A 24 at outer sides of the left and right main girders 1; a stiffened steel tube 25 is disposed between the inner and outer web plates of the left and right main girders 1, the center of circle is overlapped with that of the round holes B 22, and the inner diameter is larger than the diameter of the round holes B 22; and two ends of the stiffened steel tube 25 respectively press tightly against the inner and outer web plates of the left and right main girders 1 and are fixed by welding.

The functions of each part of the present invention are as follows. The left and right main girders 1 are spandrel girders of the upper-bearing typed movable formwork, and have greater rigidity to ensure the reasonable linear shape of the concrete box girder; the left and right guide girders 2 are extensions of the left and right main girders 1, and are disposed for meeting the running requirements of the upper-bearing typed movable formwork; the inner formwork 3, the left and right wing formworks 4, the left and right side formworks 5, and the bottom formwork 6 form a fog rework system together, and serve as a supporting structure of a reinforcement scaffolding system and a formworking bed for newly-casting concrete; the left and right landing legs 7 are a supporting structure of the left and right main girders 1, as well as slideways and reaction seats of vertical and horizontal moving of the upper-bearing typed movable formwork; the pier shaft embedded brackets 8 are a supporting structure of the left and right landing legs 7, for transferring the load of the landing legs to the pier shaft; and the vertical and horizontal transfer mechanisms 9 are a motion mechanism responsible for rising and falling, vertical transfer, and horizontal transfer of the upper-bearing typed movable formwork.

FIG. 8 is a schematic cross-sectional view along A-A of the present invention in a running state. Before the vertical transfer of the upper-bearing typed movable formwork, connection between the left and right bottom formworks 6*a* and 6*b* are released, and the vertical and horizontal transfer mechanisms 9 drag the left and right main girders and moves horizontally on the left and right landing legs 7 together with the left and right formworks, until the bottom formwork 6 does not touch the pier shaft in the vertical transfer. During this period, the left and right landing legs 7 are still fixed on the pier shaft, and relative positions of the left and right main girders 1 to the left and right wing formwork 4 and between the left and right side formwork 5 and the bottom formwork 6 are unchanged.

The present invention has the following technical features.

(1) Light dead weight and great rigidity. As the transverse truss (or the transverse steel box girder) is removed, the load transfer is simple, the rigidity of the bottom formwork is reasonably utilized, and the structure deformation is reduced, so the upper-bearing typed movable formwork has a light dead weight and great rigidity.

(2) Reasonable stress. In the load borne by the upper-bearing typed movable formwork, the dead weight load of the concrete box girder and the horizontal pressure of the newly-casting concrete account for a large proportion. In the present invention, the bottom formwork 6, the left and right bottom formwork struts 14, and the finish rolled threaded steel bars A 23 are connected to the left and right main girders 1 together, and thus a stable bearing system is formed, and the rigidity of the bottom formwork 6 is utilized. By reasonably arrangement of the adjustable struts of the left and right wing formworks 4 and the left and right side formworks 5, the stress of two web plates of the left and right main girders 1 is even. Besides, an appropriate pre-stress can be applied to the finish rolled threaded steel bars A 23, so as to effectively reduce the horizontal deformation of the left and right main girders 1.

(3) Small net occupation height. After the transverse truss (or the transverse steel box girder) is removed, the left and right main girders 1 can reasonably enter the space above the bottom surface of the concrete box girder, and the height space below the bottom surface of the concrete box girder occupied by the upper-bearing typed movable formwork is much smaller, and thus the mobile scaffolding system can be adapted to lower pier shafts.

(4) Variable span construction. The pre-camber of the bottom formwork can be secondarily adjusted by using the oblong holes 20 on the inner web plate of the left and right main girders 1, thus creating conditions for variable span construction. For example, after the same upper-bearing typed movable formwork completes the construction of a 32 m span simple box girder, the left and right bottom formwork connecting hinge supports 11 are moved up and down, and the pre-camber of the bottom formwork 6 is re-adjusted; and after the left and right side formworks 5 are changed, the mobile scaffolding system can perform the construction of a 24 m span simple box girder continuously.

(5) Constructible curved box girder. By adjusting lengths and support angles of the adjustable struts of the left and right wide formworks and the left and right side formworks, angles and positions of the left and right wide formworks and the left and right side formworks are changed, and thus the construct a curved box girder can be performed.

(6) Bidirectional construction. The UPPER-BEARING TYPED MOVABLE FORMWORK can construct forward and backward, thus avoiding turnaround in the construction site.

(7) Simplified procedures. Overall deformworking and overall formworking can be achieved without adjusting the formworks for each span, and thus the operation is simple.

Technical parameters of a certain application example (simple supported girder construction) of the present invention are as follows.

(1) construction span: 32 m, variable to 24 m.

(2) load: 900 t (3) longitudinal slope: ≦1%

(4) plane curve: R≧2000 m (5) dead weight: 375 t (not comprising the hydraulic internal formwork), lighter than the conventional UPPER-BEARING TYPED MOVABLE FORMWORK by 15-20%.

(6) elastic deflection-span ratio at full load: 1/655

(7) actual deflection-span ratio after the pre-camber included at full load: ≦1/3000

(8) vertical transfer speed: 1 m/min (9) traverse transfer speed: 0.5 m/min

(10) total power: 100 kW

(11) construction period: 9-12 days/per span

The present invention is applicable in situ casting construction of an equal-height continuous box girder.

The present invention is not limited to the above preferred embodiments. Anyone should understand that, structural variations made under the teachings of the present invention, as well as such variations have technical, solutions the same as or similar to those of the present invention shall fall within the protection scope of the present invention.

What is claimed is:

1. An upper-bearing movable formwork, comprising: left and right landing legs (7), respectively fixed on upper left and right sides of a pier shaft; left and right vertical and horizontal transfer mechanisms (9); a bearing device; and a formwork system;

wherein the left and right vertical and horizontal transfer mechanisms (9) are respectively disposed on the left and right landing legs (7) and move horizontally along the left and right landing legs (7); the bearing device includes left and right main girders (1), respectively fixed on the left and right vertical and horizontal transfer mechanisms (9); and two groups of left and right guide girders (2), respectively fixedly connected to front and back ends of the left and right main girders (1);

the formwork system includes:

a bottom formwork (6), an inner formwork (3), and left and right formworks, in which, two ends of the bottom formwork (6) are respectively fixed on two opposite inner sides of the left and right main girders (1); the inner formwork (3) is centrally disposed on the bottom formwork (6); and the left and right formworks are respectively disposed on the bottom formwork (6), and located at left and right sides of the inner formwork (3), and gaps for forming the concrete box girder are disposed between left and right outer sides of the left and right formworks and the inner formwork (3);

characterized in that:

the bottom formwork further comprising: left and right bottom formwork struts (14), the bottom formwork (6) is formed by connecting the left and right bottom formworks (6*a*), (6*b*) disposed symmetrically with respect to an axis of the concrete box girder through a bolt; an inner web plate is respectively disposed on two opposite sides of the left and right main girders (1), and left and right bottom formwork connecting hinge supports (11) and bottom formwork strut connecting hinge supports (13) are respectively disposed on the inner web plate, two ends of the bottom formwork (6) are respectively hinged with the left and right bottom formwork connecting hinge supports (11), and the left and right bottom formwork struts (14) are respectively hinged with lower surfaces of the left and right bottom formworks (6*a*), (6*b*) and the bottom formwork connecting hinge supports (13) on the inner web plate of the left and right main girders (1).

2. The upper-bearing movable formwork according to claim 1, characterized in that the left and right formworks comprising a left and right wing formwork (4) and a left and right side formwork (5) respectively; the left and right wing formworks (4) and the left and right side formworks (5) are fixedly connected to each other respectively, and lower ends of the left and right side formworks (5) are fixedly supported on the bottom formwork (6); outer surfaces of the left and right wing formworks (4) pass through left and right wing formwork upper struts (15) and left and right wing formwork lower struts (16) respectively, and the left and right wing formworks (5) are hinged on upper surfaces of the left and right main girders (1) respectively through left and right side formwork upper struts (17), left and right side formwork middle struts (18), and left and right side formwork lower struts (19).

3. The upper-bearing movable formwork according to claim 1, characterized in that three vertical oblong holes (20) are opened on the inner web plate of the left and right main girders (1), at least three round holes (21) are opened on bottom plates of the left and right bottom formwork connecting hinge supports (11), and the left and right bottom formwork connecting hinge supports (11) are connected with the inner web plate through a bolt.

4. The upper-bearing movable formwork according to claim 3, characterized in that contact surface of the left and right bottom formwork connecting hinge supports (11) and the inner web plate of the left and right main girders (1) is a rough surface machined with sandblasting for rusting or aluminum spraying.

5. The upper-bearing movable formwork according to claim 1, characterized in that an outer web plate is respectively disposed at outer sides of the left and right main girders (1), the inner web plate at two sides of bottom formwork strut connecting hinge supports (13) is disposed with at least two holes (22) running through the inner and outer web plates of the left and right main girders (1) symmetrically; and finish rolled threaded steel bars (23) of a number equal to that of the holes B (22) are fixedly connected with the outer web plate of the left and right main girders (1) respectively through the holes (22).

6. The upper-bearing movable formwork according to claim 5, Characterized in that a portion of the finish rolled threaded steel bars (23) located between the inner and outer web plates of the left and right main) girders (1) is respectively sleeved with stiffened steel tubes (25), and two ends of the stiffened steel tubes (25) are respectively fixed with the inner and outer web plates of the left and right main girders (1) by welding.

7. The upper-bearing movable formwork according to claim 1, characterized in that Left and right brackets (8) are embedded at two sides of the pier shaft, the left and right landing legs (7) are respectively fixedly connected to the left and right brackets (8), and left and right landing legs (7) at two sides of the same pier shaft are fixed diagonally with a finish rolled threaded steel bar.

8. The upper-bearing movable formwork according to claim 2, characterized in that the left and right bottom formwork struts (14), the left and right wing formwork upper struts (15), the left and right wing formwork lower struts (16), the left and right side formwork upper struts (17), the left and right side formwork middle struts (18), and the left and right side formwork lower struts (19) respectively include a supporting steel tube (28), a left nut (29), a right nut (30), left and right screws (32, 33) connected with the left and right nuts (29, 30) through threads, and at least two rotation handles (31), in which rotation directions of inner threads of the left and right nuts (29, 30) are opposite, the inner threads are respectively welded at two ends of the supporting steel tubes (28), and the at least two rotation handles (31) are respectively disposed on outer surfaces of the supporting steel tube (28).

* * * * *